US008905039B2

(12) United States Patent
Miller

(10) Patent No.: US 8,905,039 B2
(45) Date of Patent: Dec. 9, 2014

(54) CIGAR HOLDER

(76) Inventor: Paul E. Miller, Tacoma, WA (US)

( * ) Notice: Subject to any disclaimer, the term of this patent is extended or adjusted under 35 U.S.C. 154(b) by 1003 days.

(21) Appl. No.: 12/447,401

(22) PCT Filed: Oct. 26, 2007

(86) PCT No.: PCT/US2007/082684

§ 371 (c)(1),
(2), (4) Date: Feb. 5, 2010

(87) PCT Pub. No.: WO2008/055075

PCT Pub. Date: May 8, 2008

(65) Prior Publication Data

US 2010/0139673 A1 Jun. 10, 2010

Related U.S. Application Data

(60) Provisional application No. 60/863,325, filed on Oct. 27, 2006.

(51) Int. Cl.
*A24F 13/02* (2006.01)
*A24F 13/22* (2006.01)

(52) U.S. Cl.
CPC ..... *A24F 13/22* (2013.01)
USPC ..... 131/187; 131/258; 131/241; 131/260; D27/183; D27/192

(58) Field of Classification Search
None
See application file for complete search history.

(56) References Cited

U.S. PATENT DOCUMENTS

| | | | | | |
|---|---|---|---|---|---|
| 2,777,447 | A | | 1/1957 | Gossler | |
| 3,689,687 | A | * | 9/1972 | Bosch | 174/161 R |
| 4,055,193 | A | | 10/1977 | Lehman | |
| D311,600 | S | * | 10/1990 | Peracca | D27/183 |
| D385,940 | S | * | 11/1997 | Justice | D21/794 |
| 5,842,481 | A | | 12/1998 | King | |
| 6,463,936 | B1 | * | 10/2002 | Hicks | 131/256 |

* cited by examiner

*Primary Examiner* — Richard Crispino
*Assistant Examiner* — Phu Nguyen
(74) *Attorney, Agent, or Firm* — Seed IP Law Group PLLC

(57) ABSTRACT

A device for holding a cigar relative to a supporting object, the device including a receiver adapted to receive the cigar with a loose fit and a clamp for releasably attaching the receiver to the supporting object to hold the cigar at a desired location and in a desired orientation, preferably in a vertical orientation.

3 Claims, 3 Drawing Sheets

CIGAR HOLDER

BACKGROUND OF THE INVENTION

1. Field of the Invention

The present invention pertains to devices for holding and stabilizing cylindrical objects and, more particularly, to a portable and adjustable receiver that is configured and dimensioned to be larger than the outer diameter of a cigar so that it receives a cigar with a loose fit and retains the cigar in a preferred orientation.

2. Description of the Related Art

Attempts have been made over the years to accommodate resting of a lit cigar in a manner that provides for easy manual manipulation of the cigar while safely locating the cigar away from flammable material. While various devices exist for other objects, such as candleholders, such designs do not address the desirable features associated with smoking a cigar.

For example, Schlueter et al., U.S. Pat. No. 414,871, describes and illustrates a candleholder that includes a spring-biased clamp for attaching the candleholder onto a Christmas tree. One handle of the spring-biased clamp utilizes a single wire clamp to vertically orient a candle. This design would not work for a cigar because it does not facilitate easy placement and removal of the cigar. Rather, it is designed to firmly hold the candle in position on the tree.

A design specific for cigars is found in Knudsen, U.S. Pat. No. 1,198,929, which describes a cigar holder that clamps a cigar in a vertical orientation. This design requires permanent attachment to a fixed surface and is not transportable. In addition, the holder fails to accommodate the reduced length of a cigar as it burns down.

Allen et al., U.S. Pat. No. 4,178,346, pertains to an incense-burning device that includes a spring-biased clamp, which can be clamped onto an edge of a vehicle ashtray, and a cylindrical container. This design is not sized to hold a cigar and the clamp member will not secure the weight of a cigar. Moreover, the clamp requires a surface set at a specific angle in order to maintain the upright orientation of the incense.

In U.S. Design Pat. No. D385,940 a cylindrical cigar holder that has a closed end and an open end is illustrated. The use of a stake requires the holder be used only on the ground, which can result in the holder and cigar being left behind.

BRIEF SUMMARY OF THE INVENTION

The present design is directed to a tubular cigar receiver that includes an open end and a closed end; and a spring-biased clamp attached to an outer wall of the tubular cigar receiver. The tubular cigar receiver has an internal diameter dimensioned to be larger than the outer diameter of a cigar so that it receives a cigar with a loose fit. The clamp removably attaches the receiver to an object to support the cigar (such as a lit cigar) at a desired location and in a desired orientation, preferably in a vertical orientation.

In accordance with another embodiment of the present disclosure, a device for holding a lit cigar in relation to a supporting object is provided, the device including a receiver portion configured to receive the cigar with a loose fit, and means for releasably attaching the receiver to the supporting object in a manner that the lit cigar is held in a preferred or selected orientation.

In accordance with another aspect of the present disclosure, a cigar holder is provided for holding a cigar to a supporting object, the holder including a receiver having a sidewall defining an open interior that is closed at one end by an end wall and open at an opposing end, the interior sized and shaped to receive the cigar with a loose fit, and a clamp comprising first and second clamping members, each clamping member having a handle portion and a jaw portion, the handle portion of the first clamping member attached to the receiver and the second clamping member pivotally attached to the first clamping member, and a biasing means for urging the first and second handle members away from each other and the corresponding jaw members toward each other with a force that causes the jaw members to clamp the supporting object with sufficient force to retain the clamp in engagement with the supporting object.

In accordance with another embodiment of the disclosure, a device for holding a cigar to a supporting object, the device including a receiver having a cylindrical sidewall defining an open interior that is closed at one end by an end wall and open at an opposing end, the interior sized and shaped to receive the cigar with a loose fit; and a clamp comprising first and second clamping members, each clamping member having a handle portion and a jaw portion, the handle portion of the first clamping member attached to the receiver and the second clamping member coupled to the first clamping member and to the receiver, and a spring adapted to urge the second handle member away from the first handle member and the corresponding jaw member of the second clamping member towards the jaw member of the first clamping member with a force that enables the jaw members to clamp on the supporting object with sufficient force to retain the clamp in engagement with the supporting object and to hold the receiver in a substantially vertical orientation.

In accordance with another aspect of the present disclosure, the first clamping member and second clamping member are configured to pivot together with respect to the receiver to enable selective orientation of the receiver relative to the clamp and relative to a supporting object.

BRIEF DESCRIPTION OF THE DRAWINGS

The foregoing and other features and advantages of the present invention will be more readily appreciated as the same becomes better understood from the detailed description of the invention when considered in conjunction with the following drawings, wherein.

DETAILED DESCRIPTION OF THE INVENTION

Figure 1A:
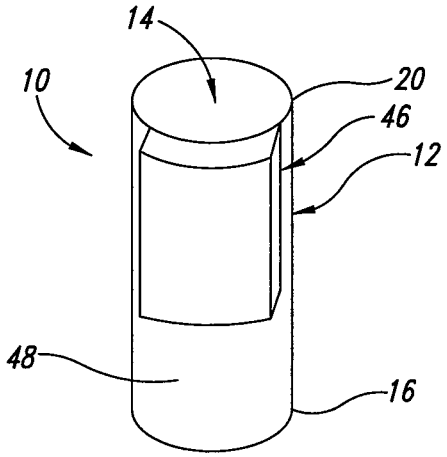
FIGS. 1A-1B are top and bottom isometric projections, respectively, of a cigar receiver tube formed in accordance with one embodiment of the present invention.

Referring to FIGS. 1A-1B through 4A-4B, shown therein is a cigar holder consisting of a receiver tube 10 having a cylindrical or tubular sidewall 12 defining an open interior 14 closed at one end 16 by a planar end wall 18 and having an opposing open end 20.

Figure 4A:
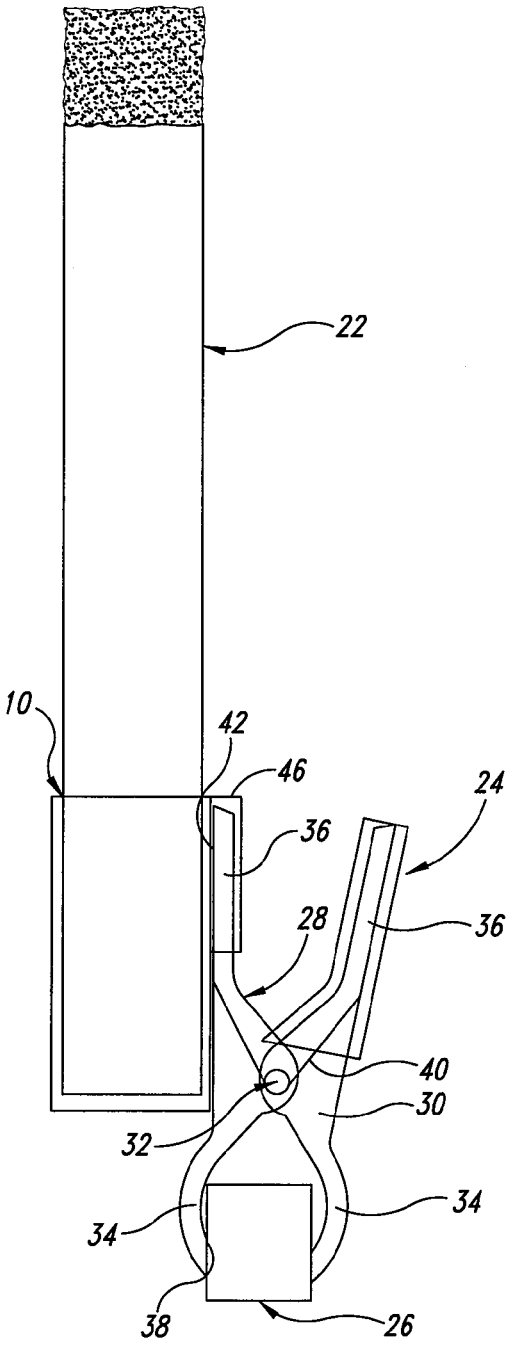
FIGS. 4A-4B are side and end views, respectively, of the cigar holder of FIGS. 3A-3B in use holding a cigar relative to a support structure in accordance with the present disclosure.
Figure 4B:
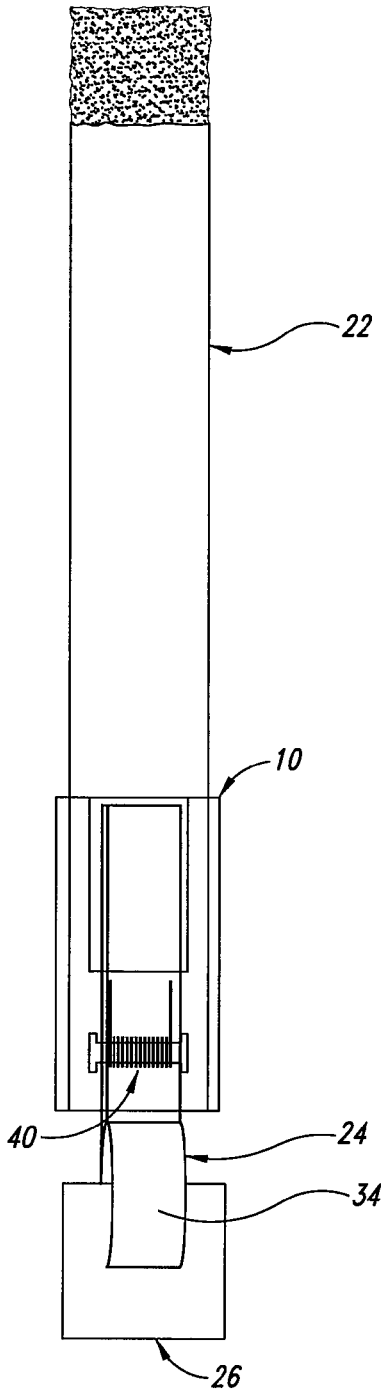

Ideally, the receiver tube 10 is sized to have a diameter large enough to accommodate a cigar 22 with a loose fit, as illustrated in FIGS. 4A-4B. In one embodiment the receiver tube 10 has a preferred diameter of 1.0 inch O.D. (0.93 I.D.), with an acceptable range to be 0.75 inch to 1.25 inch O.D. The length is preferably 2 inches with an acceptable range of 1.5 inches to 2.5 inches.

Figure 1B:
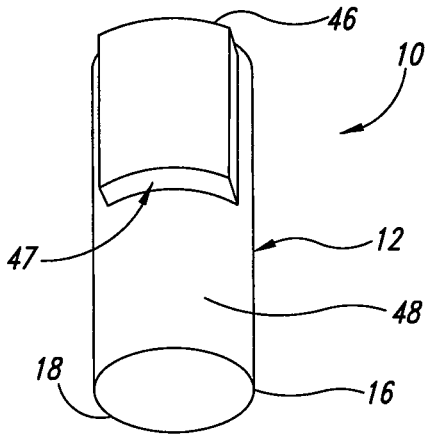

Although a preferred embodiment for the receiver tube 10 is shown in FIGS. 1A-1B, it is to be understood that other shapes and configurations may be used. For example, the receiver tube 10 may have a cross-sectional configuration other than circular, such as square, triangular, pentagonal, and other known polygonal shapes, as well as oblong, rectangular, diamond, rhombus, and the like. Moreover, while the end wall 18 is shown to be planar or flat, it may be formed to have a convex or convex shape that may be pre-stressed to provide reinforcing strength to the sidewall 12 to withstand forces generated in use, as described in more detail below.

In an alternative embodiment, the end wall may include one or more openings to facilitate removal of the cigar from the receiver tube 10 after the cigar has burned down. Preferably at least one opening is sized to allow an object to be inserted into the receiver tube 10, such as a golf tee, to push the shortened cigar out of the receiver tube 10.

Various materials may be used to construct the receiver tube 10, including metal, such as steel, aluminum, cast iron, wrought iron, and various other metal alloys, as well as materials such as plastic, wood, and glass of a suitable thickness. Combinations of any of the foregoing materials are also possible.

Figure 2A:
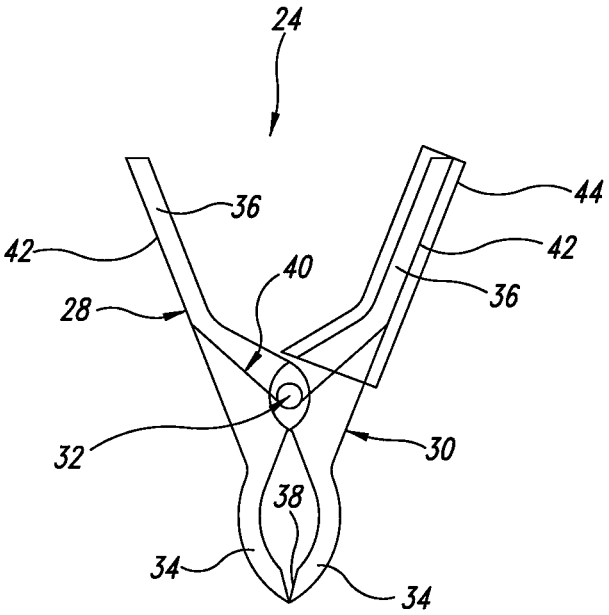
FIGS. 2A-2B are side and end views, respectively, of a clamp formed in accordance with one embodiment of the present invention.
Figure 2B:
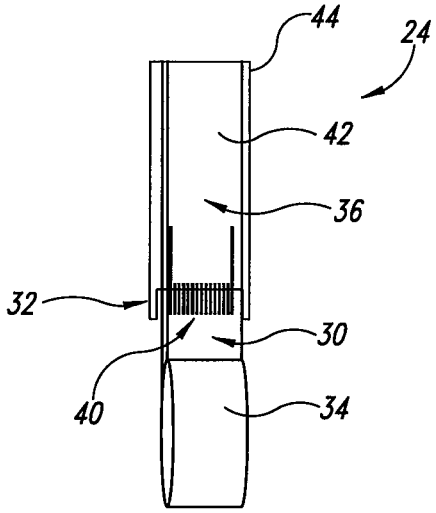

FIGS. 2A-2B are illustrations of a clamp 24 for use in mounting the receiver tube 10 to a supporting object 26, as shown in FIGS. 4A-4B. The clamp 24 has a conventional design and will not be described in detail herein. Briefly, the clamp 24 includes first and second clamping members 28, 30 pivotally attached together by a pivot pin 32. Each clamping member includes a jaw 34 and a handle 36 that are preferably integrally formed together. The jaw 34 includes a distal end face 38 that is preferably flat and may include serrations or stippling or other surface finish that aids in maintaining a grip on the supporting object 26 to minimize both slippage of the clamp 24 and damage to the supporting object 26.

The handle 36 is of sufficient length to provide leverage for a user's fingers in overcoming the force of a spring member 40 that urges the jaws 36 together when the clamp 24 is assembled. In one embodiment the spring exerts a force of preferably 6 pounds of pressure, although an acceptable range of spring force is 5 pounds to 7 pounds of pressure. Each handle 36 preferably includes a flat portion 42 that, in one instance, provides a bearing surface for a user's finger or thumb and, in another instance, provides a mounting surface for attachment to the receiver tube 10 as described in more detail hereinbelow. A protective cover 44 is placed over the handle 36 of one clamping member 30 for increased gripping action upon the handle 36 and improved comfort for the user.

Figure 3A:
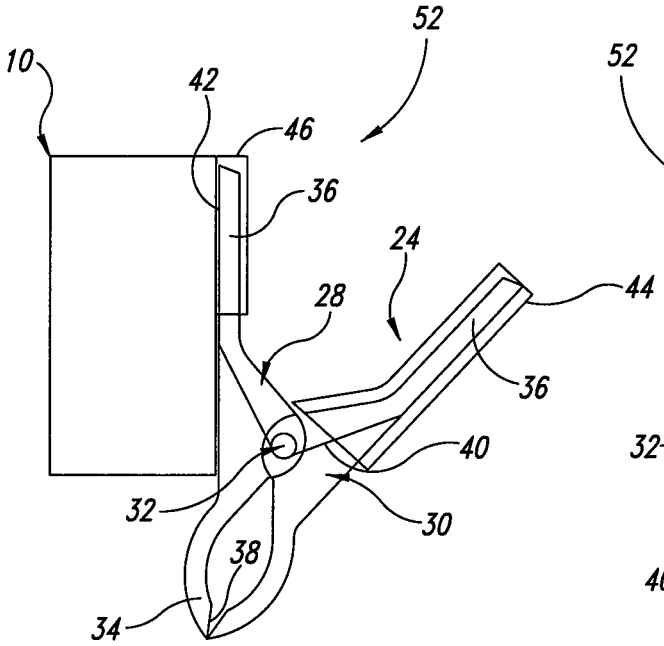
FIGS. 3A-3B are side and end views, respectively, of the clamp of FIGS. 2A-2B attached to the receiver tube of FIGS. 1A-1B to form a cigar holder in accordance with the present disclosure.
Figure 3B:
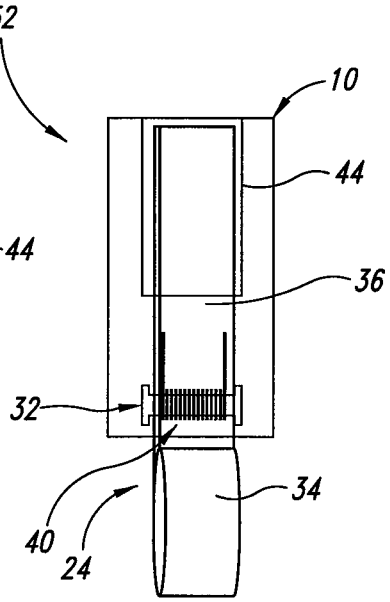

FIGS. 3A-3B show the clamp 24 attached to the receiver tube 10. More particularly, the receiver tube 10 has an attachment case 46 formed on the outer surface 48 of the sidewall 12, preferably located adjacent the open end 20 of the receiver tube 10. The case 46 is, in the illustrated embodiment, a second wall attached to or formed on the exterior surface 48 of the receiver tube 10 with closed sidewalls and top wall but with an open bottom 47 that opens to an interior or pocket that is sized and shaped to receive the handle 36 of one of the clamping members 28, 30 in slidable engagement. The handle 36 is secured to the receiver tube 10 preferably by gluing or welding. In another embodiment other known attachment means, including fasteners such as one or more rivets, screws, bolts, and the like, can be used.

The case 46 can be integrally formed with the receiver tube 10 or it can be a separate element that is attached to the receiver tube 10. As a separate element, the case 46 can be adhesively attached to the receiver tube 10 using a suitable adhesive. The dimensions of the attachment case 46 are such that it will provide sufficient space in the interior thereof to receive the handle 36 through the open bottom 47. The attachment case 46 can be convex to match the convex curvature of the receiver tube 10 or the outer wall can be planar.

The handle 36 of the clamp can be shaped to nest with the exterior surface 48 of the receiver tube 10. For example, the surface of the handle 36 can be concave to match the convex outer surface 48 of the receiver tube 10.

When the clamp 24 is attached to the receiver tube 10, the one clamp member 28 will have its jaw extending past the closed end 16 of the receiver tube 10 as shown in FIG. 4A. Ideally, the jaw 34 has an arcuate shape to accommodate the supporting object 26 as shown. Having the clamp 24 extend past the closed end 16 provides room for the curved jaw 34.

It is to be understood that the clamp 24 can also be attached to the side of the receiver tube 10 with an angle bracket such that the clamping members 28, 30 pivot in a plane that does not intersect a longitudinal axis of the receiver tube 10, although this is not preferred because of weight, manufacturing, and cost concerns.

In another embodiment, the handle 36 can pivot with respect to the receiver tube 10 as described more fully below. In this embodiment, the second wall would not be used, and the clamp 24 would have a first clamping member attached directly to the receiver tube 10 to move in unison with a second clamping member relative to the receiver tube. In another embodiment the clamp is fixed relative to the receiver tube, such as by having the first clamping member fixedly attached to the receiver tube and the second clamping member moving with respect to the first clamping member to enable clamping to a supporting object. In yet another embodiment only one clamping member can be used and the receiver tube 10 can act as a second clamping member.

In operation, the cigar holder 52 is, in one manner of use, first attached to a supporting object by the clamp 24 so that the receiver tube 10 is at a desired location and desired orientation. For example, as shown in FIGS. 4A-4B, the receiver tube 10 is oriented vertically so that the cigar 22 will be held in a vertical orientation. The receiver tube 10 and the free handle 36 of the clamp are squeezed together by a user's fingers to open the jaws 34 sufficiently wide to slip the clamp over the supporting object. The supporting object 26 can be a golf bag handle, golf cart dash, chair handle, raised side of a table, handlebar, or other available surface, such as found in golf carts, boats, bikes, wheelchairs, walkers, automobiles, and the like.

In another embodiment, the clamp 24 can be mounted to the receiver tube 10 such that its orientation with respect to the receiver tube 10 can be changed. For example, if a single rivet attaches the clamp 24 to the receiver tube 10, the clamp 24 could rotate about the rivet, thus permitting a change in the orientation of the receiver tube 10. This enables the clamp to be attached to a greater variety of objects and enables the user to adjust the receiver tube 10 to either a vertical, horizontal, or other angle of orientation between vertical and horizontal. For example, the cigar can be positioned near the horizontal so that the ashes from the cigar fall into an ashtray positioned below the cigar holder 52.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. For example, the receiver tube 10 can include an embossment for the placement of a logo, trademark, advertising, or identification indicia, or a combination of the foregoing. The exterior face of the case 46 can be used for this purpose as can the outer surface 48 of the receiver tube 10. Accordingly, the invention is not limited except as by the appended claims.

The invention claimed is:

1. A device for holding a cigar to a supporting object, the device comprising:

a receiver having a sidewall defining an open interior that is closed at one end by an end wall and open at an opposing end, the interior sized and shaped to receive the cigar with a loose fit, the receiver including an attachment case formed on an exterior of the sidewall and having closed sidewalls, a closed end wall, and an open end that communicates with an interior of the attachment case; and a clamp comprising first and second clamping members pivotally attached together, each clamping member having a handle portion and a jaw portion, the handle portion of the first clamping member coupled to the receiver via the attachment case in which the handle portion of the first clamping member is slidably received through the open end and inside the interior of the attachment case, the first clamping member structured to cooperate with the receiver so that the receiver and the handle portion of the first clamping member cooperate to function as the handle portion of the first clamping member, and a biasing device structured to urge the first and second handle members away from each other and the corresponding jaw members toward each other with a force that enables the jaw members to clamp on the supporting object with sufficient force to retain the clamp in engagement with the supporting object and to hold the cigar while it is lit in a preferred orientation.

2. The device of claim 1, wherein the receiver has a cross-sectional configuration of one from among circular, polygonal, rectangular, oblong, diamond, and trapezoidal.

3. A system for holding a lit cigar in relation to a supporting object, comprising a device of claim 1, further comprising an ash tray structured to be positioned below the device when the device is attached to the supporting object so as to catch ashes from the lit cigar when the lit cigar is in the receiver.

* * * * *